US005324019A

United States Patent [19]

Chang et al.

[11] Patent Number: 5,324,019

[45] Date of Patent: Jun. 28, 1994

[54] AUTOMATIC DOCUMENT FEEDER WITH SOLID BRACKET

[75] Inventors: Seung M. Chang, Yangchun-Gu; Young J. Kwon, Sungbuk-Gu, both of Rep. of Korea

[73] Assignee: Sindo Ricoh Co., Ltd., Seoul, Rep. of Korea

[21] Appl. No.: 87,392

[22] Filed: Jul. 2, 1993

[30] Foreign Application Priority Data

Jul. 11, 1992 [KR] Rep. of Korea ..... 1992-12384

[51] Int. Cl.[5] ..... B65H 3/52

[52] U.S. Cl. ..... 271/124; 271/121; 271/272; 271/273

[58] Field of Search ..... 271/34, 121, 124, 125, 271/272, 273

[56] References Cited

U.S. PATENT DOCUMENTS 4,376,530 3/1983 Akai ..... 271/121

FOREIGN PATENT DOCUMENTS 0136837 6/1986 Japan ..... 271/124
0066046 3/1988 Japan .
0267229 10/1989 Japan ..... 271/272
0013529 1/1990 Japan ..... 271/121

*Primary Examiner*—H. Grant Skaggs
*Attorney, Agent, or Firm*—Darby & Darby

[57] ABSTRACT

An automatic document feeder (ADF) with a solid bracket suitable for use with an office machine to separate a plurality of documents one by one, and to feed the separated document to the office machine. The solid bracket comprises a pair of side plates, a stationary belt supporter and a shaftless roller supporter extending between the side plates, and a pair of spring supporters connected to the side plates through individual bent connections. The ADF further includes a rotatable shaft supporting the belt and controlling the tensile force of the belt, and a document separating roller coming into close contact with the belt at a position opposed to a shaftless roller. The tension coil springs are connected between the rotatable shaft and the spring supporters to bias the rotatable shaft and to control the tensile force of the belt. The endless document separating belt is rotatably supported by both the stationary belt supporter and the rotatable shaft. The shaftless roller is supported by the shaftless roller supporter such that it comes into contact with inner surface of the belt while freely shifting upwards and downwards.

5 Claims, 4 Drawing Sheets

AUTOMATIC DOCUMENT FEEDER WITH SOLID BRACKET

BACKGROUND OF THE INVENTION

1. Field of the Invention

The present invention relates in general to accessories of an office machine, and more particularly to an automatic document feeder suitable for use with the office machine to separate a plurality of documents, set on a document feeding base of the office machine, one by one and to feed the separated document to the office machine.

2. Description of the Prior Art

Some of known office machines, such as a copying machine, a laser printer and a facsimile, is preferably equipped with an automatic document feeder (ADF) at its document feeding section. The ADF is adapted to automatically separate a plurality of documents one by one and to feed the separated document to the office machine, thereby improving the document processing performance of the office machine.

The ADF according to the prior art generally includes a document separating belt and a document separating roller which come into close contact with each other for separating the plurality of documents one by one and for feeding the separated document. Here, when separating the documents, the document separating roller is rotated while the document separating belt is not moved. Since the separating belt is not moved as aforementioned, a part of the separating belt comes into repeated contact with the rotating roller and is inevitably abraded, thereby shortening the using life of the belt and requiring to be often substituted with new one. Moreover, the abrasion of the document separating belt causes deterioration of the document separating and feeding performance of the ADF. Additionally, it is required to make the rotating separating roller come into direct contact with the fixed separating belt prior to introduction of the document to the nip between the separating roller and the separating belt, and this generates a remarkable frictional force between the belt and roller. The roller driving motor of the ADF is thus imparted with a remarkable load.

In an effort to solve the above problems, the applicant proposed an automatic document feeder in Korean U.M. Application No. 91-11586.

With reference to FIG. 1, there is shown in a perspective view the automatic document feeder of the above Korean U.M. application. This document feeder includes an endless document separating plane belt 13 which is rotatably supported by both a stationary belt roller 12 and a rotatable belt roller 15 and comes into close contact with a document separating roller 18. The rotatable roller 15 is supported by a rotating shaft 15*a* which is in turn provided at both ends thereof with individual larger diameter supports 16. Each of the supports 16 is in turn movably inserted in a slot 14*a* formed in each side wall of a rotation-side bracket 14. Hence, the rotatable roller 15 is rotated along with the rotating shaft 15*a* rotatably supported by the bracket 14. On the other hand, the stationary roller 12 is supported by a rectangular shaft 12*a* which extends from the opposite side ends of the roller 12 and is in turn inserted in a rectangular slot 11*a*, formed in each side wall of a stationary-side bracket 11, such that it is prevented from rotation. Here, the rotating shaft 15*a* is upwardly and backwardly biased by means of biasing means, such as a pair of tension coil springs 17 each connected between the rotating shaft 15*a* and an upper cover (not shown) of the document feeder main body. Thanking for the springs 17, the separating belt 13 always comes into close contact with the separating roller 18 with an appropriate tensile force.

However, the above document feeder, while somewhat lengthening the using life of the document separating belt 13 and improving the document separating and feeding performance of the document feeder, nevertheless has a problem caused by its complicated structure. Otherwise stated, the stationary-side bracket 11 and the rotational-side bracket 14 are separately mounted on the main body of the document feeder and, particularly, the rotation-side bracket 14 should be provided with the slot 14*a* for maintaining the desired tensile force of the document separating belt 13 using the springs 17. Moreover, the tension coil springs 17 are additionally connected to the upper cover of the main body. Hence, the problem of the above document feeder is resided in that it is difficult to manufacture and to assemble the feeder and to substitute a trouble element with new one.

SUMMARY OF THE INVENTION

It is, therefore, an object of the present invention to provide an automatic document feeder in which the above problem can be overcome and which has a solid bracket structure having a simple construction suitable for easily mounted on the main body of the feeder, thus remarkably lengthening the using lift of a document separating belt and improving the document separating and feeding performance.

To accomplish the above of the object, an automatic document feeder in accordance with an embodiment of the present invention comprises a solid bracket comprising: a pair of side plates; a stationary belt supporter extending between the side plates so as to define a predetermined interval between the side plates and to support a document separating belt; a shaftless roller supporter extending between the side plates so as to define the predetermined interval between the side plates, the roller supporter supporting a shaftless roller; and a pair of spring supporters connected to outer surfaces of the side plates through individual bent connections at a side opposite to the belt supporter, the pair of spring supporters being connected to individual tension coil springs; a rotatable shaft provided at the side opposite to the stationary belt supporter such that it is rotated at the same time of rotation of an endless document separating belt, the rotatable shaft being rotatably connected at its opposite ends to and biased by the tension coil springs, thereby controlling a tensile force of the document separating belt; the pair of tension coil springs connected between the opposite ends of the rotatable shaft and the pair of spring supporters, respectively, so as to bias the rotatable shaft and to control the tensile force of the document separating belt; the endless document separating belt rotatably supported by both the stationary belt supporter of the solid bracket and the rotatable shaft; the shaftless roller supported by the shaftless roller supporter such that it comes into contact with inner surface of the document separating belt while freely shifting upwards and downwards; and a document separating roller coming into close contact with the document separating belt at a position opposed to the shaftless roller, the document separating roller being rotated by a rotational force of an additional drive power source.

The automatic document feeder further includes means for preventing two or more documents to be fed at a time, the means being mounted on lower surface of the connections connecting the spring supporters to the side plates.

In order to make the solid bracket be easily mounted on the document feeder, the automatic document feeder includes a mounting plate extending outwardly from the outer surface of each of the side plates.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENT

Figure 2:
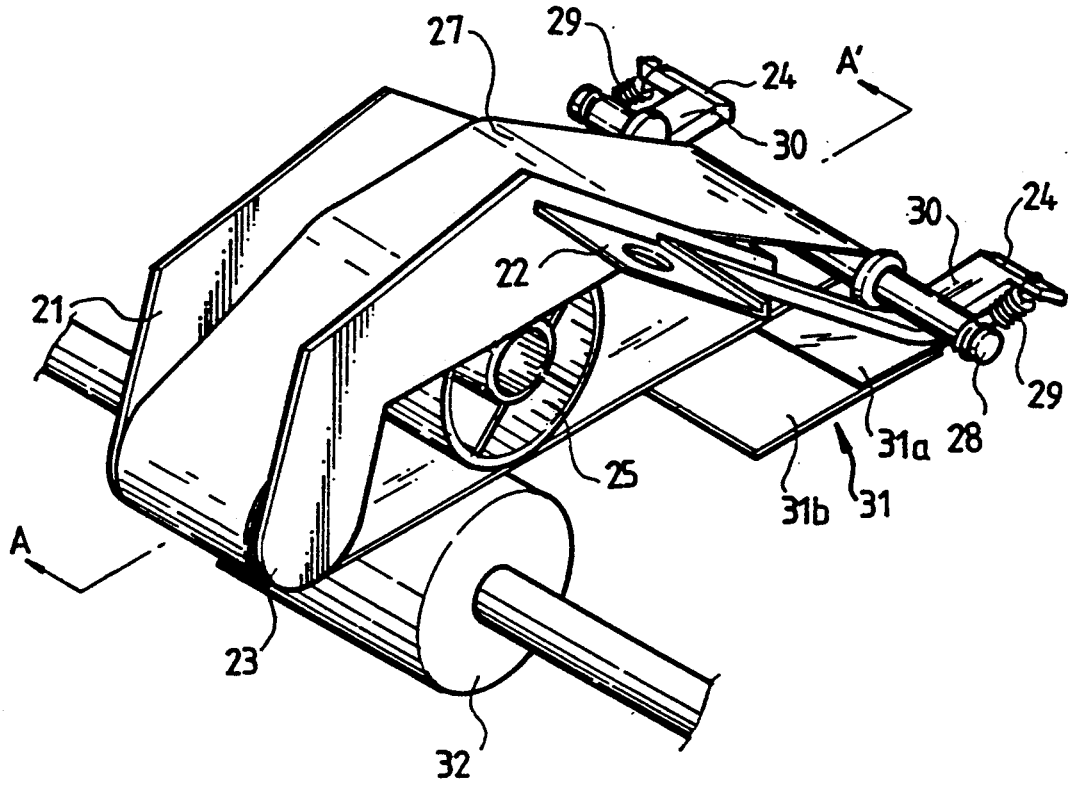
FIG. 2 is a perspective view of an automatic document feeder with a solid bracket in accordance with a preferred embodiment of the present invention.
Figure 3:
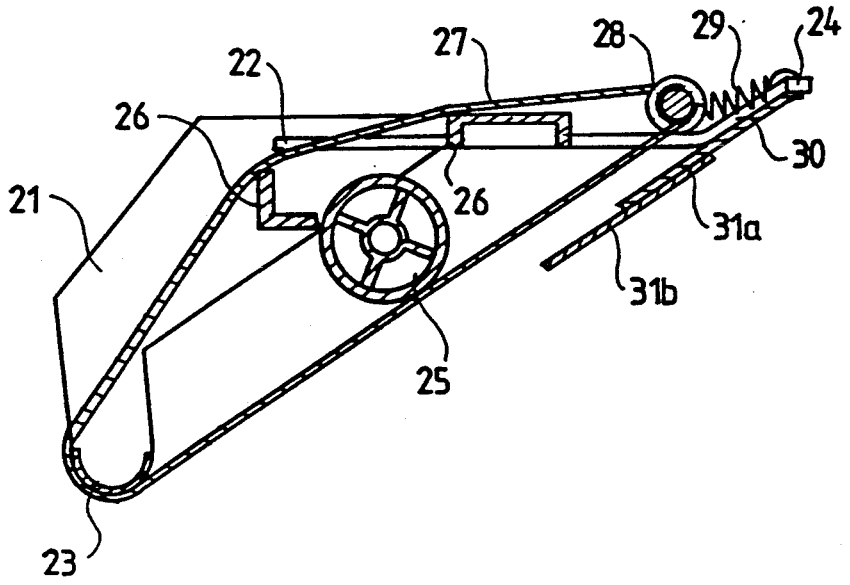
FIG. 3 is a sectional view of the document feeder taken along the section line A–A' of FIG. 2.
Figure 4:
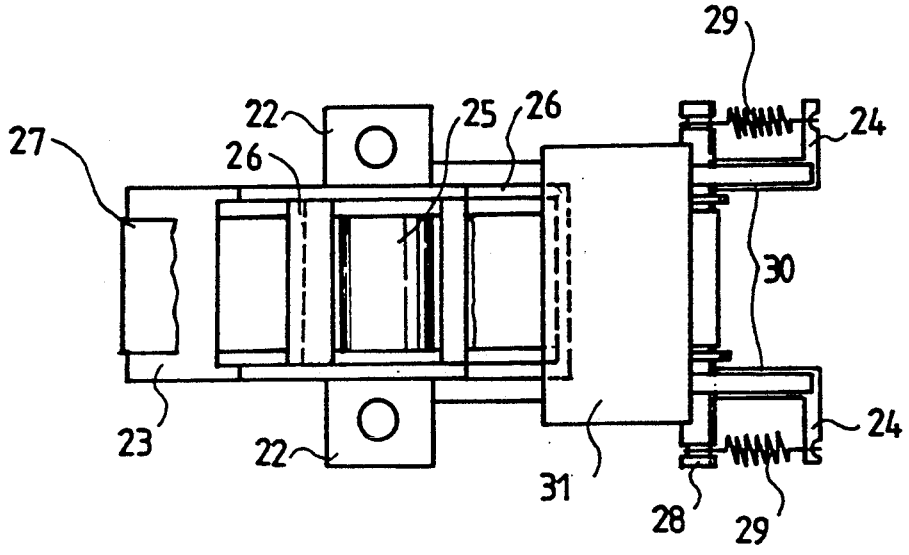
FIG. 4 is a bottom view of the document feeder of FIG. 2.

With reference to the drawings, FIG. 2 is a perspective view of an automatic document feeder with a solid bracket in accordance with a preferred embodiment of the present invention, FIG. 3 is a sectional view taken along the section line A–A' of FIG. 2, and FIG. 4 is a bottom view of the document feeder.

Figure 1:
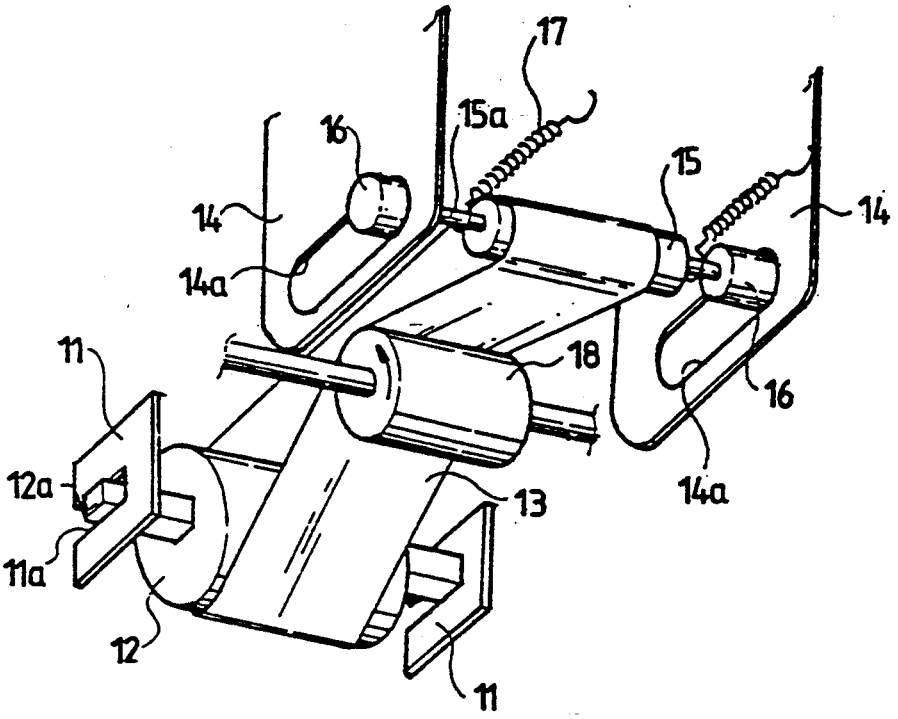
Fig.1 PRIOR ART
FIG. 1 is a bottom perspective view of an automatic document feeder in accordance with the prior art.

The document feeder of this invention includes a solid bracket preferably produced by an injection molding using a mold. The solid bracket comprises a pair of side plates 21 to which a stationary belt supporter 23 (see FIG. 3) is integrally connected at its opposite ends for defining a predetermined interval between the two side plate 21 as well as supporting a document separating belt 27. The interval between the plates 21 is also supported by a shaftless roller supporter 26 which is directly connected at its opposite ends to the side plates 21. This roller supported 26 has a space slightly larger than the outer diameter at the shaftless roller 25. This supporter 26 also has an additional function for supporting a shaftless roller 25 described later herein. At a side opposite to the belt supporter 23, a pair of spring supporters 24 are integrally formed with the side plates 21, respectively, and each connected to an end of a tension coil spring 29. Each of the spring supporters 24 is connected to a corresponding side plate 21 through a bent connection 30 extending from the outer surface of the side plate 21 to the spring supporter 24. A rotatable shaft 28 is provided at the side opposite to the stationary belt supporter 23 so as to rotatably support the document separating belt 27. The rotatable shaft 28 is elastically rotatably connected at its opposite ends to the tension coil springs 29 such that it is rotated by the frictional force caused by the movement of the belt 27. This rotatable shaft 28 supports the belt 27 and pulled by the tension coil springs 29 to maintain the predetermined tensile force of the belt 27. The rotatable shaft 28 is laid on the bent connections 30 of the spring supporters 24. The shaftless roller 25 is supported by the shaftless roller supporter 25 such that it comes into contact with the document separating belt 27 while freely shifting upwards and downwards. The document feeder further includes a document separating roller 32 which is opposed to the shaftless roller 25 and comes into contact with the belt 27 passing between the two rollers 25 and 32 as shown in FIG. 1. The tension coil springs 29 are connected between the opposite ends of the rotatable shaft 28 and the spring supporters 24 of the solid bracket, respectively. These tension coil springs 29 pull the rotatable shaft 28 so as to provide a predetermined tensile force, required in the desired document separation and document feeding operation, for the document separating belt 27.

In order to facilitate the mounting work of the solid bracket of the document feeder on a conventional office machine, such as a copying machine, the solid bracket is additionally provided with a pair of mounting plates 22 which extend outwardly from the outer surfaces of the side plates 21, respectively, as shown in FIG. 1.

In addition, the document feeder of this invention also includes means for preventing feeding of two or more documents at a time. Thanking for this means, the plurality of documents are fed in such a manner that only one document is fed to the nip between the document separating belt 27 and the document separating roller 32 at a time without failure. In accordance with the preferred embodiment shown in FIGS. 1 and 2, the means for preventing the feeding of two or more documents at a time comprises an excess feeding restriction plate 31 mounted on the lower surfaces of the connections 30. The plate 31 includes a Mylar sheet 31*a* of which the upper section is mounted on the lower surfaces of the inclined lower sections of the bent connections 30 while the lower section of the sheet 31*a* is oriented toward the document separating roller 32. The Mylar sheet 31*a* is thus inclined with respect to the upper sections of the bent connections 30. The plate 31 further includes a cork sheet 31*b* which is mounted on the lower surface of the Mylar sheet 31*a* and generates a predetermined frictional force suitable for effectively preventing two or more documents from being fed at a time. This restriction plate 13 has an appropriate detention force thanking for the specific characteristics of both the Mylar sheet 31*a* and the cork sheet 31*b*.

In wrapping the endless document separating belt 27 around both the stationary belt supporter 23 and the rotatable shaft 28, the predetermined tensile force of the belt 27 should be achieved. In order to rotate the document separating roller 32, the document feeder further includes a drive power source (not shown).

When giving the gist of the present invention, this document feeder remarkably improves the document separation and feeding performance by increasing an area of the document separating belt 27 contacting with the document separating roller 32. Such an increase of the contact area of the belt 27 is achieved by the presence of shaftless roller 25. In addition, the solid bracket has the mounting plates 22 provided on the outer surfaces of the opposite side plates 21, thus causing the document feeder to be easily adapted for use with a conventional office machine.

Hereinbelow, the operational effect of the document feeder of this invention will be described.

The separating roller 32 requires to have a predetermined coefficient of friction higher than that of the separating belt 27. In addition, it is also required to construct the document feeder such that the frictional force between the separating roller 32 and the separating belt 27 is higher than the sum of a frictional forces, that is, a frictional force between the separating belt 27 and the stationary belt supporter 23, a frictional force between the separating belt 27 and the rotatable shaft 28 and a frictional force between the separating belt 27 and the shaftless roller 25. The rotatable shaft 28 is rotated at the same time of rotation of the separating belt 27. The shaftless roller 25 is not fixed at its rotating center but comes into contact with the separating belt 27, thereby rotating in a space between the shaftless roller supporter 26 and the separating belt 27 when the separating belt 27 is rotated by the rotational force of the separating roller 32.

Therefore, in the case of unloading state wherein no document is nipped between the separating belt 27 and the separating roller 32, the rotational force of the separating roller 32 is transmitted to the separating belt 27 and causes this belt 27 to be rotated. All of the separating belt 27, the shaftless roller 25 and the rotatable shaft 28 are thus rotated together when there is no document introduced to the nip between the belt 27 and the roller 32, thereby preventing unnecessary power loss as well as abrasion of the separating belt 27.

On the contrary, in the case of a loading state wherein a document is nipped between the separating belt 27 and the separating roller 32, the document feeding operation and the belt rotation are influenced by the result of the frictional force comparison, that is, the comparison of a frictional force between the document and the separating roller 32 with a frictional force between the document and the separating belt 27. Here, the frictional force between the document and the separating roller 32 is higher than that between the document and the separating belt 27 as a result of the aforementioned difference of the coefficient of friction between the separating roller 32 and the separating belt 27. Thus, the separating belt 27 does not move but feeds the document.

When at least two documents are nipped between the separating roller 32 and the separating belt 27 at a time, the document feeding operation and the belt rotation are influenced by the result of the frictional force comparison among the frictional force between the document and the separating roller 32, a frictional force between the documents and the frictional force between the document and the separating belt 27. Here, the frictional force between the document and the separating roller 32 is highest while the frictional force between the documents is lowest, so that there occurs a slide between the documents and this prevents transmission of the rotational force of the separating roller 32 to the separating belt 27. Thus, the separating belt 27. does not move while only the document directly contacting with the separating roller 32 is separated and fed to the office machine.

In result, it is noted that the separating belt 27 does not rotate in the case of the document loading state but rotates in the case of the document unloading state as described above. Therefore, the document separating belt 27 always separates the plurality of documents and feeds a separated document to the office machine in combination with the document separating roller 32. In addition, since the separating belt 27 is selectively rotated and its surface position contacting with the separating roller 32 is varied, so that the whole surface of the separating belt 27 is evenly abraded.

On the other hand, the document separating and feeding efficiency of the separating roller 32 may be reduced as a result of an inevitable abrasion of both the separating roller 32 and the separating belt 27 caused by a long time use thereof. However, this problem can be solved by the novel structure of this document feeder. That is, the rotatable shaft 28 is always pulled by the tension coil springs 29 such that the separating belt 27 comes into close contact with the separating roller 32 with the predetermined tensile force. The using life of the document feeder is thus lengthened irrespective of the aforementioned inevitable abrasion.

When the document feeder is adapted for use with a conventional office machine in which the document is set with an inclination or which is provided with document feeding accessaries, such as a document leading roller, two or more documents may be fed to the nip between the separating belt 27 and the separating roller 32 at a time.

However, the document feeder of this invention overcomes the above problem by providing the excess feeding restriction plate 31 which is mounted on the lower surface of the connections 30 and prevents the feeding of two or more documents at a time. This plate 31 is mounted on the lower surface of the inclined lower section of the bent connections 30 of the spring supporters 24.

As aforementioned, the plate 31 comprises the Mylar sheet 31*a* of which the upper section is mounted on the lower surface of the inclined lower section of the bent connections 30 while the lower section of the sheet 31*a* is oriented toward the document separating roller 32, so that the Mylar sheet 31*a* is inclined with respect to the upper sections of the bent connections 30. The plate 31 further includes the cork sheet 31*b* mounted on the lower surface of the Mylar sheet 31*a* and generating the predetermined frictional force suitable for effectively preventing two or more documents from the being fed at a time. This restriction plate 31 has the appropriate detention force thanking for the specific characteristics of both the Mylar sheet 31*a* and the cork sheet 31*b*. Of course, it should be understood that the cork sheet 31*b* may be substituted with another sheet, such as a rubber sheet, which yields the same result as that described for the cork sheet 31*b* without affecting the functioning of this invention. In addition, the desired frictional force will be achieved by making the sheets 31*a* and 31*b* have different sizes.

Figure 5:
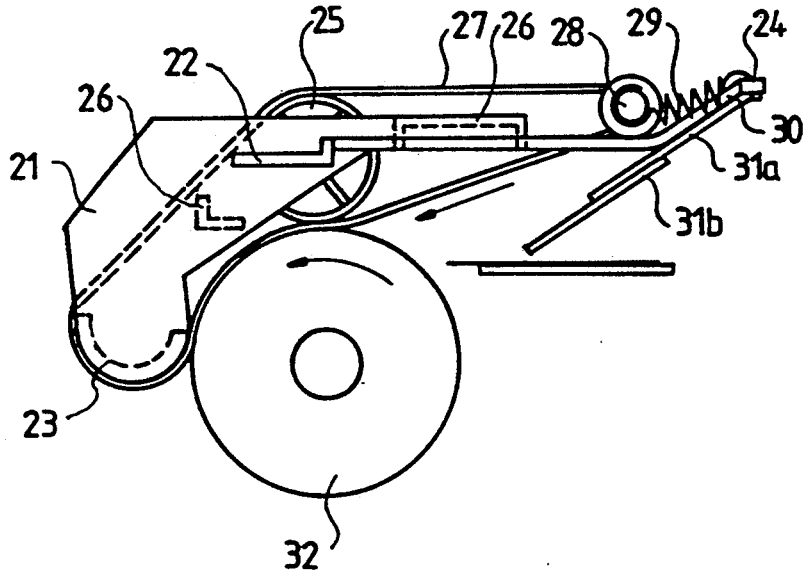
FIG. 5 is a front view showing an operation of the document feeder of FIG. 2.

FIG. 5 is a front view showing the document separating and feeding operation of the document feeder of this invention. As shown in this drawing, when the document separating roller 32 is counterclockwise rotated as shown at the arrow under the condition that no document is nipped between the separating roller 32 and the separating belt 27, the rotational force of the roller 32 is directly transmitted to the separating belt 27 contacting with the roller 32, thereby causing the belt 27 to be rotated along with the separating roller 32. Particularly at this time, the shaftless roller 25 comes into contact with the belt 27 at its upper section and at its lower section, so that it increases the area of the belt 27 contacting with the separating roller 32 and transmits the rotational force of the lower belt 27 to the upper belt 27 so as to cause a desired smooth rotation of the belt 27.

However, when a document is introduced to the nip between the separation belt 27 and the separating roller 32, the rotational force of the roller 32 is not transmitted to the belt 27 any more, so that the rotation of the belt 27 is stopped. At this state, the rotational force of the roller 32 is transmitted to the document and makes this document be fed to the office machine.

As described above, the present invention provides an automatic document feeder which improves the document separating and feeding performance by selectively rotating the separating belt and remarkably reducing the abrasion of the separating belt. The separating belt maintains its desired tensile force and increases in its area where it comes into contact with the document separating roller, thus improving the reliability of the document separating and feeding performance. The document feeder is also provided with a solid bracket having a mounting plate which makes the document feeder to be easily adapted for use with a conventional office machine. In addition, the document feeder prevents two or more documents from being fed to the office machine at a time, thus doubling the improvement of the document separating and feeding performance.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. An automatic document feeder comprising:

a solid bracket comprising:

a pair of side plates;

a stationary belt supporter extending between said side plates so as to define a predetermined interval between said side plates and to support a document separating belt;

a shaftless roller supporter extending between said side plates so as to define said predetermined interval between said side plates, said roller supporter supporting a shaftless roller; and a pair of spring supporters connected to outer surfaces of said side plates through individual bent connections at a side opposite to said belt supporter, said pair of spring supporters being connected to individual tension coil springs;

a rotatable shaft provided at the side opposite to said stationary belt supporter such that it is rotated at the same time of rotation of an endless document separating belt, said rotatable shaft being rotatably connected at its opposite ends to and biased by said tension coil springs, thereby controlling a tensile force of said document separating belt;

said pair of tension coil springs connected between the opposite ends of said rotatable shaft and said pair of spring supporters, respectively, so as to bias said rotatable shaft and to control said tensile force of said document separating belt;

said endless document separating belt rotatably supported by both said stationary belt supporter of said solid bracket and said rotatable shaft;

said shaftless roller supporter by said shaftless roller supporter such that it comes into contact with inner surface of said document separating belt while freely shifting upwards and downwards; and a document separating roller coming into close contact with said document separating belt at a position opposed to said shaftless roller, said document separating roller being rotated by a rotational force of an additional drive power source.

2. An automatic document feeder according to claim 1, further comprising:

means for preventing two or more documents to be fed at a time, said means being mounted on lower surfaces of said connections connecting said spring supporters to said side plates.

3. An automatic document feeder according to claim 2, further comprising:

a mounting plate extending outwardly from the outer surface of each of said side plates so as to make said solid bracket be easily mounted on said document feeder.

4. An automatic document feeder according to claim 2, wherein said means comprises:

a Mylar sheet, an upper section of said Mylar sheet being mounted on the lower surface of inclined lower sections of said bent connections, and a lower section of said Mylar sheet being oriented toward said document separating roller such that said Mylar sheet is inclined with respect to the upper sections of said bent connections;

a cork sheet mounted on a lower surface of said Mylar sheet so as to prevent two or more documents from being fed at a time.

5. An automatic document feeder according to claim 1, further comprising:

a mounting plate extending outwardly from the outer surface of each of said side plates so as to enable said solid bracket to be easily mounted on said document feeder.

* * * * *